US005915795A

United States Patent [19]

Nakamura et al.

[11] Patent Number: 5,915,795

[45] Date of Patent: Jun. 29, 1999

[54] CHAIN SAW BRAKING DEVICE

[75] Inventors: Kazuya Nakamura, Singapore; Makoto Mizutani, Anjo; Masaki Kondo, Anjo; Hideyuki Nakadachi, Anjo, all of Japan

[73] Assignee: Makita Corporation, Anjo, Japan

[21] Appl. No.: 08/948,950

[22] Filed: Oct. 10, 1997

Related U.S. Application Data

[63] Continuation-in-part of application No. 08/630,498, Apr. 10, 1996, abandoned.

[30] Foreign Application Priority Data

Apr. 11, 1995 [JP] Japan ..... 7-85310

[51] Int. Cl.[6] ..... B27B 17/00

[52] U.S. Cl. ..... 30/382; 30/381; 188/77 W

[58] Field of Search ..... 30/381, 382, 383; 188/77 R, 77 W, 166; 83/816.1

[56] References Cited

U.S. PATENT DOCUMENTS

| | | | |
|---|---|---|---|
| 3,785,465 | 1/1974 | Johansson | 30/383 |
| 3,793,727 | 2/1974 | Moore | 30/383 |
| 4,573,556 | 3/1986 | Andreasson | 30/382 |
| 4,594,780 | 6/1986 | Schliemann et al. | 30/382 |
| 4,625,406 | 12/1986 | Fushiya et al. | 30/381 |
| 4,680,862 | 7/1987 | Wieland et al. | 30/381 |
| 4,683,660 | 8/1987 | Schurr | 30/382 |
| 4,757,881 | 7/1988 | Jonsson et al. | 30/382 |
| 4,782,593 | 11/1988 | Kieser et al. | 30/382 |
| 4,811,487 | 3/1989 | Takahashi et al. | 30/382 |
| 4,882,844 | 11/1989 | Stokan | 30/381 |
| 4,920,649 | 5/1990 | Ström et al. | 30/382 |
| 4,991,297 | 2/1991 | Cain | 30/382 |
| 5,480,009 | 1/1996 | Wieland et al. | 30/382 |
| 5,709,032 | 1/1998 | Mizutani et al. | 30/382 |
| 5,791,057 | 8/1998 | Nakamura et al. | 30/382 |
| 5,813,123 | 9/1998 | Wieland et al. | 30/382 |

FOREIGN PATENT DOCUMENTS

| | | |
|---|---|---|
| 33 08 400 A1 | 9/1983 | Germany . |
| 33 24 628 A1 | 1/1985 | Germany . |
| 34 19 152 A1 | 11/1985 | Germany . |
| 36 39 650 A1 | 6/1988 | Germany . |
| 43 30 850 A1 | 3/1995 | Germany . |
| 58-180738 | 10/1983 | Japan . |
| WO 82/00437 | 2/1982 | WIPO . |

*Primary Examiner*—Hwei-Siu Payer
*Attorney, Agent, or Firm*—Davis and Bujold

[57] ABSTRACT

A chain saw brake device that can instantly halt the rotation of a cutting chain when a motor drive switch is turned off. The chain saw brake device includes a brake band wound around a brake drum, such that by operating a hand guard and pulling the forward end of the brake band, the brake band is tightened around the brake drum, thereby stopping the cutting chain. The rear end of the brake band is fixed to a bent rod, and the bent rod is urged rearwardly by a coil spring when the drive switch is turned off, causing the brake band to tighten around the brake drum. By activating a trigger lever, the movable member, engaged with the trigger lever, is moved forwards, thereby pushing forwards the bent rod, and loosening the brake band.

8 Claims, 7 Drawing Sheets

CHAIN SAW BRAKING DEVICE

This is a continuation-in-part of application Ser. No. 08/630,498 filed Apr. 10, 1996 and entitled "A Chain Saw Braking Device", now abandoned.

FIELD OF THE INVENTION

This invention relates to a brake device for use in a chain saw that can instantly halt the rotation of a cutting chain.

BACKGROUND OF THE INVENTION

In a conventional chain saw, a hand guard for protecting operator's hands is provided in front of a handle. Additionally, a brake band is wound around a brake drum which also serves as a centrifugal clutch drum, for stopping the operation of a cutting chain. By operating the hand guard and pulling one end of the brake band, the brake drum is tightened with the brake band, thereby stopping the fitting chain.

However, in such chain saw, even after a trigger switch for supplying power to a motor is turned off, the inertial rotation of the motor often results in the rotation of the cutting chain for several seconds. If the rotating chain contacts or hits the ground, it often damages, thereby requiring the replacement of the chain itself. Furthermore, the operator cannot go to the subsequent steps of work until the chain is completely stopped. Thus, the work efficiency is deteriorated.

SUMMARY OF THE INVENTION

Wherefore, an object of the present invention is to provide a brake device for use in a chain saw that can quickly stop the rotation of a cutting chain when a power switch is released.

To achieve this or other object, the present invention provides a chain saw brake device provided with a cutting chain wound around a guide bar extending forwards from a housing, a drive means for providing a rotary drive force to a drive sprocket onto which the cutting chain is wound, and a trigger member or an urging means provided with or without a switch for energizing the drive means at an ON position and for stopping the drive means at an OFF position. A brake band is wound around a brake drum secured onto the drive sprocket, and a hand guard is connected to one end of the brake band. By operating the hand guard and pulling the end of the brake band, the brake band is tightened around the brake drum, thereby stopping the cutting chain. The other end of the brake band is fixedly secured to a movable member. The movable member is designed to cooperate with the trigger member, such that the brake band is pulled and tightened when the trigger member is in the OFF position and the brake band is released or loosened when the trigger member is in the ON position.

In the brake device, while the trigger member is in the OFF position, the movable member pulls the brake band such that the brake band is tightened around the brake drum, thereby halting the rotation of the cutting chain. When the trigger member is gripped or turned on, the movable member is operated such that the brake band is loosened, thereby releasing the brake drum and permitting the cutting chain to rotate.

When the brake device is mounted on an electromotive chain saw, as the drive means an electromotive motor is provided in the housing for providing a rotary drive force to the drive sprocket. The trigger member is designed to switch on or off the drive switch of the electromotive motor, such that electricity is conducted to the electromotive motor when the trigger member is at its ON position and the supply of electricity is stopped when it is at its OFF position.

When the brake device is mounted on an engine driven chain saw, as the drive means, an engine is provided in the housing for providing a rotary drive force to the drive sprocket. The trigger member is designed to switch on or off a fuel valve, such that the rotational frequency of the engine is increased when the trigger member is in its ON position and that of the engine is decreased when it is in its OFF position. Alternatively, the trigger member can be designed to turn on or off a clutch, such that the clutch is turned on to transmit the engine drive force to the sprocket when the trigger member is in its ON position and the clutch is turned off when the trigger member is in its OFF position.

The movable member can be a wire with which the brake band is pulled. The brake band usually made of steel or other resilient material can be easily tightened or loosened just by pulling or releasing the brake band.

To be more reliable, the movable member can be a reciprocatable rod member. When the trigger member is brought in its ON position, the brake band is pushed back into its release position by the rod member. Consequently, the brake device can be sure to be released.

Specifically, an urging member is attached to the rod member, such that the brake band is pulled and tightened around the brake drum. Additionally, a switch is turned on by gripping or turning on the trigger member. A link member can be disposed between the trigger member and the rod member for pushing the rod member against the urging force of the urging member when the trigger member is gripped.

In the brake device, when the trigger member is gripped or turned on, the rod member is pushed forwards by the link member against the force of the urging member. Therefore, the brake band is loosened and the chain is allowed to rotate. On the other hand, when the trigger member is released, the link member is also released. By the force of the urging member, the rod member is pulled in the direction in which the brake band is tightened. Consequently, almost at the same time when the trigger member is released, the brake band is tightened around the brake drum, thereby stopping the chain instantly.

In the chain saw brake device, the support end of the oscillatable trigger member is remote from the rod member. When the trigger member is gripped or turned on, the link member, engaged with the free end of the trigger member and the rear end of the rod member, can be moved toward the side of the rod member. In such structure, the trigger member as well as the link member can be moved sufficiently largely, such that the rod member can be pushed against the urging force to surely loosen the brake band. Since the mechanism for securely loosening the brake band is established, the urging member providing a strong force can be used. When the trigger member is released or turned off, the rod member can be instantly operated, and a braking force can be quickly applied.

In the chain saw brake device, the rod member can be made of a bent rod extended along the vicinity of a side wall in a chain saw body case. Such rod member can obviate the necessity of a large space therefor.

As aforementioned, in the invention, when the trigger member is turned off or released, the rotation of the cutting chain is instantly halted. The cutting chain is prevented from being damaged or from damaging any material in process inadvertently. The flow of work steps is proceeding efficiently without being interrupted.

In the invention the brake device operated in cooperation with the hand guard is connected to the normal brake device operated in cooperation with the trigger member. When the trigger member of the normal brake device is brought to the OFF position, the connected end of the brake band is pulled and the brake device incorporating the hand guard is operated. The brake device provided with the hand guard pulls and tightens the brake band in the direction opposite to the direction in which the normal brake device pulls and tightens the brake band. The position on the brake band for receiving the brake force applied from the operation of the hand guard is deviated from that for receiving the brake force applied from the normal brake device. Therefore, the provision of the brake device operatively connected with the hand guard is prevented from adding to the wear which could be caused by the normal brake device.

The other end of the brake band other than the end connected to the hand guard is fixed to the movable member. Just by operating the movable member in cooperation with the trigger member, the normal brake device can be operated. No large modification of the conventional structure is required or no complicated structure is required.

BRIEF DESCRIPTION OF THE DRAWINGS

The invention will now be described, by way of example, with reference to the drawings, in which.

DETAILED DESCRIPTION OF THE PREFERRED EMBODIMENTS

Figure 1:
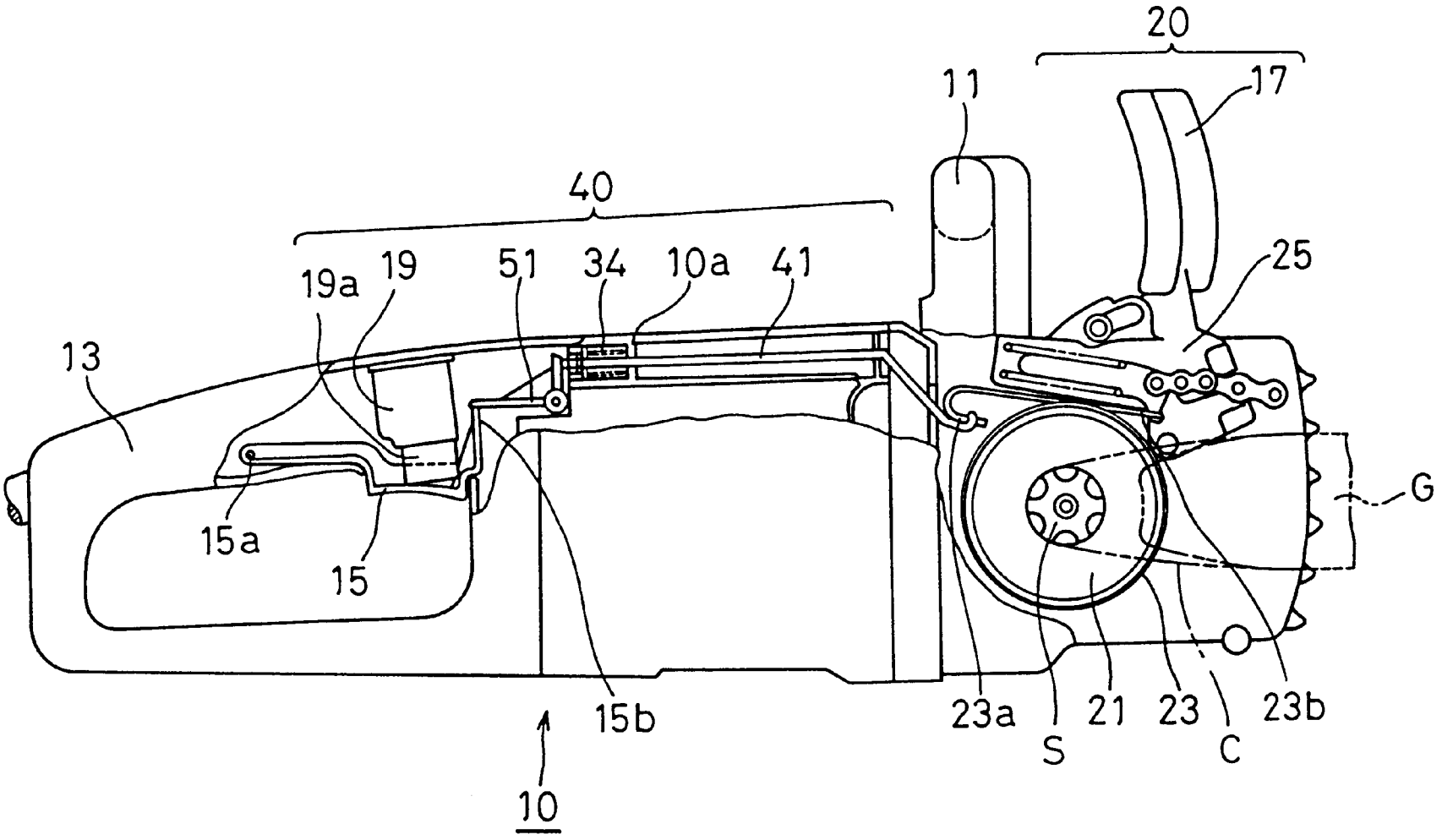
FIG. 1 is a cut away side view of a chain saw embodying the invention.

As shown in FIG. 1, in an electromotive chain saw 10 of an embodiment, a chain C is wound around a guide bar G extending from a housing (not-shown) and is driven with an electromotive motor (not-shown) built in the housing. The electromotive chain saw 10 is manually held with forward and rearward handles 11, 13. The grip of the rearward handle 13 is provided with a movable trigger lever 15. A hand guard 17 is disposed in front of the forward handle 11, with a brake device 20 built therein, which is operated by turning the hand guard 17 clockwise. The trigger lever 15 is normally urged by a spring having a switch built therein, in a clockwise direction as seen in FIG. 1, and is brought in contact with a push button 19*a* of an electromotive motor power switch 19.

Figure 3:
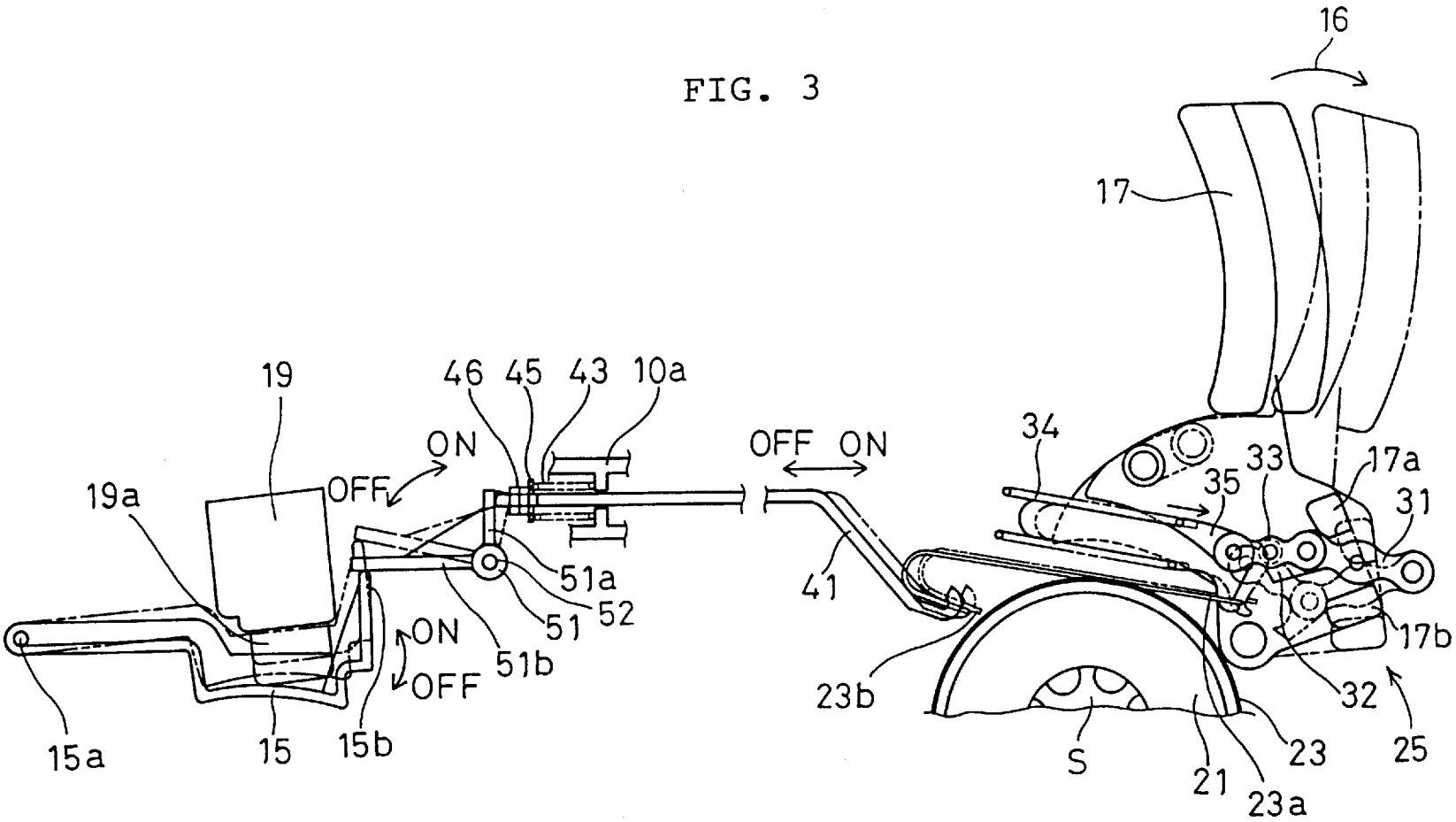
FIG. 3 is an enlarged view of the brake device for use in the chain saw of the embodiment.

As shown in FIG. 3, the brake device 20 applied in cooperation with the hand guard 17 is formed with a steel brake band 23 wound around a brake drum 21. The brake drum 21 serves also as a centrifugal clutch drum, and is securely attached onto a sprocket S. The brake device 20 is also provided with a linkage 25 for connecting a forward end 23*a* of brake band 23 to the hand guard 17. The linkage 25 is formed with a forward end link plate 31 interposed between engagement projections 17*a*, 17*b* of hand guard 17. The forward end link plate 31 is interconnected with a middle link plate 33 by a rearward jaw 32. The middle link plate 33 is further interconnected with a rear end link plate 35 which is urged forwards by a coil spring 34.

When the hand guard 17 is in an initial position as shown by a solid line in FIG. 3, the link plates 31, 33, 35 are aligned, thereby pushing against the coil spring 34, loosening the brake band 23 and permitting the brake drum 21 to rotate. When the hand guard 17 is rotated clockwise as shown by an arrow 16 in FIG. 3, the projection 17*a* of hand guard 17 lowers downward the forward end link plate 31, as shown by a two-dotted line in the figure. As a result, the middle link plate 33 is disengaged from the rearward jaw 32 and is rotated, thereby pulling the rear end link plate 35 forwards. The coil spring 34 is thus immediately extended, thereby quickly tightening the brake band 23. The brake drum 21 is forced to stop and the chain C is also stopped.

Figure 2:
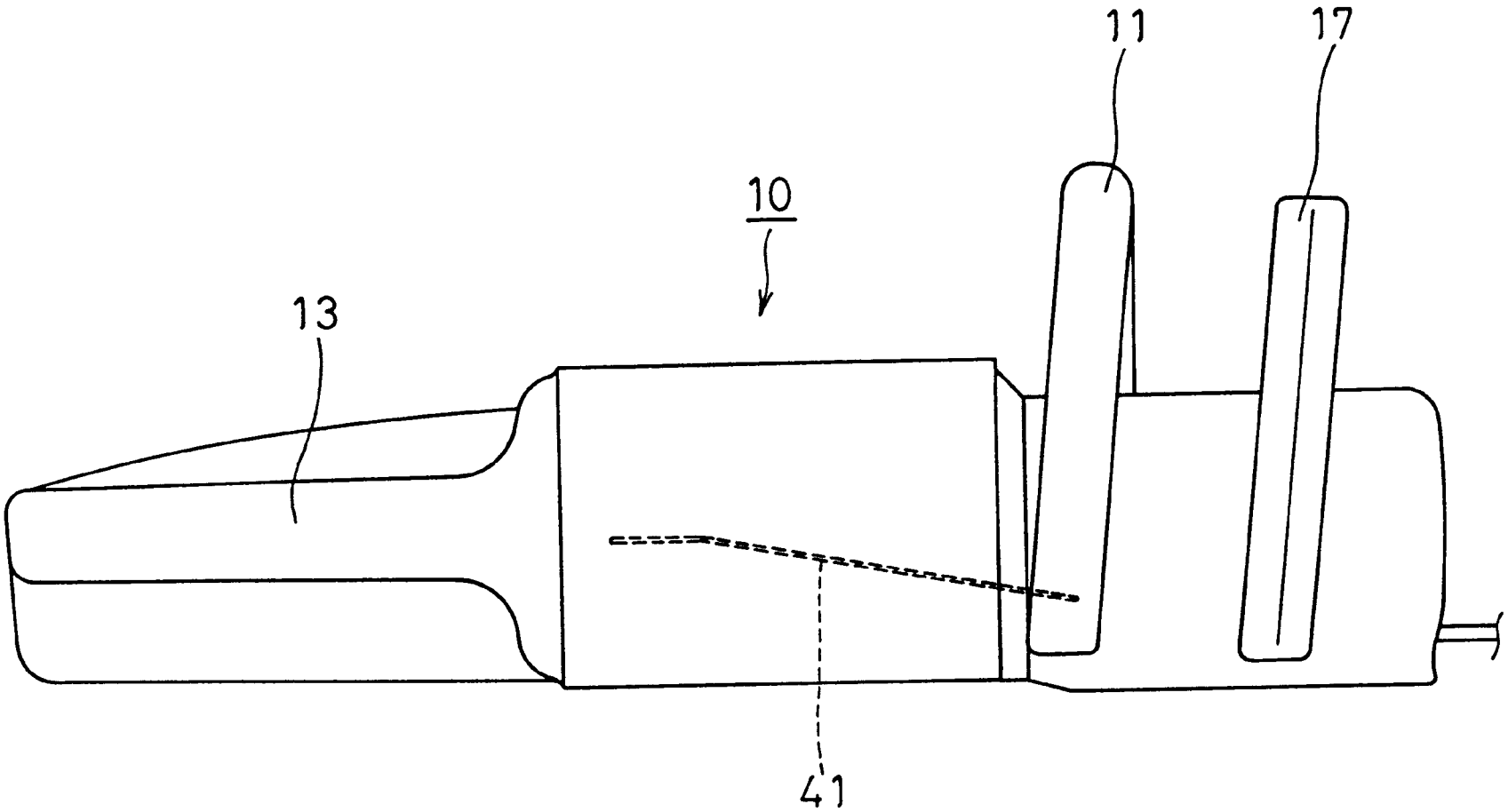
FIG. 2 is a plan view of the chain saw of the embodiment.

As shown in FIGS. 1, 2 and 3, a rear end 23*b* of brake band 23 is fixedly hooked on a bent rod 41, such that a normal brake device 40 is formed with the power switch 19. The bent rod 41 is reciprocatably supported in a body case 10*a*. The rear end of bent rod 41 is secured to the rear end of coil spring 43 via a washer 45 and a double nut 46. The forward end of coil spring 43 is secured to part of the body case 10*a*. The bent rod 41 is thus urged rearwardly by the coil spring 43.

The rear end of the bent rod 41 is engaged with an upwardly extending lever 51*a* of a movable member 51 rotatable about a rotational center 52. The movable member 51 is engaged with the forward end of the trigger lever 15 by its rearward lever 51*b* extending perpendicularly from the upwardly extending lever 51*a*. The trigger lever 15 is rotatably supported on a support 15*a*, and a forward end 15*b*, remote from the support 15*a*, is largely moved by turning on or off the power switch 19.

In operation, when the power switch 19 is turned off, as shown by the solid line in FIG. 3, the movable member 51 of the brake device 40 is moved in a counterclockwise direction as seen in the figure by means of the force of the coil spring 43, thereby pulling the belt rod 41 rearwardly. Therefore, the brake band 23 is pulled or tightened, thereby applying a braking force onto the brake drum 21.

When the trigger lever 15 is gripped and the power switch 19 is turned on, as shown by a two-dotted line in FIG. 3, the movable member 51 is pushed in a clockwise direction as seen in the figure. The rear end of the bend rod 41 is thus pushed forwards. The compression of coil spring 43 permits the bend rod 41 to slide forwards. Accordingly, the brake band 23 is loosened, also using the restoring force of its material, steel.

In the chain saw 10 of the embodiment, when the trigger lever 15 is gripped and the power switch 19 is turned on, the brake band 23 is loosened, thereby permitting the brake drum 21 to rotate and rotating the chain C. When the power switch 19 is turned off and the trigger lever 15 is released, the bent rod 41 is pressed rearwardly, urged by the coil spring 43, thereby pulling the rear end 23*b* of brake band 23. Consequently, the brake band 23 rapidly tightens around the brake drum 21, preventing the chain C from rotating with inertial force.

As aforementioned, when the cower switch 19 is turned off and the trigger lever 15 is released, the brake band 23 tightens around the brake rum 21, thereby instantly stopping the brake drum 21 and the chain C. This prevents the flow of work steps from being interrupted.

For this purpose, in the brake device 20 cooperating with the hand guard 17 according to the embodiment, the rear end 23*b* of the brake band 23 is operatively connected via the bent rod 41 with the normal brake device 40. Such brake mechanism is achieved with a minimum number of components and such a simple mechanical structure.

The brake device 40 cooperating with the power switch 19 exerts a braking or tightening force to the brake band 23 in the direction opposite to the force exerted to the brake band 23 by the operation of hand guard 17. The friction face of the brake band 23 in contact with the brake drum 21 when the brake device 20 is operated differentiated from the face of the brake band in contact with brake drum when the brake device 40 is operated. Therefore, the brake band 23 is prevented from being worn quickly in an identical area by the frictional force.

Furthermore, as shown in FIGS. 1 and 2, the usual brake device 40 is formed in a clearance in the vicinity of side walls of the body case 10*a* using the bent rod 41, without increasing the size of the chain saw 10.

This invention has been described above with reference to the preferred embodiment as shown in the figures. Modifications and alterations may become apparent to one skilled in the art upon reading and understanding the specification. Despite the use of the embodiment for illustration purposes, the invention is intended to include all such modifications and alterations within the spirit and scope of the appended claims.

For example, the brake device 40 can be mounted on an engine driven chain saw, such that a clutch turning on/off switch is incorporated.

Although the clutch drum is integrated with the brake drum in the embodiment, a separate clutch drum can be provided, as necessary.

The power switch of the electromotive chain saw can be formed integrally with the trigger lever. Even when mounted on the engine driven chain saw, the trigger lever can serve as a valve and/or clutch operating member.

A second embodiment is now described.

Figure 4:
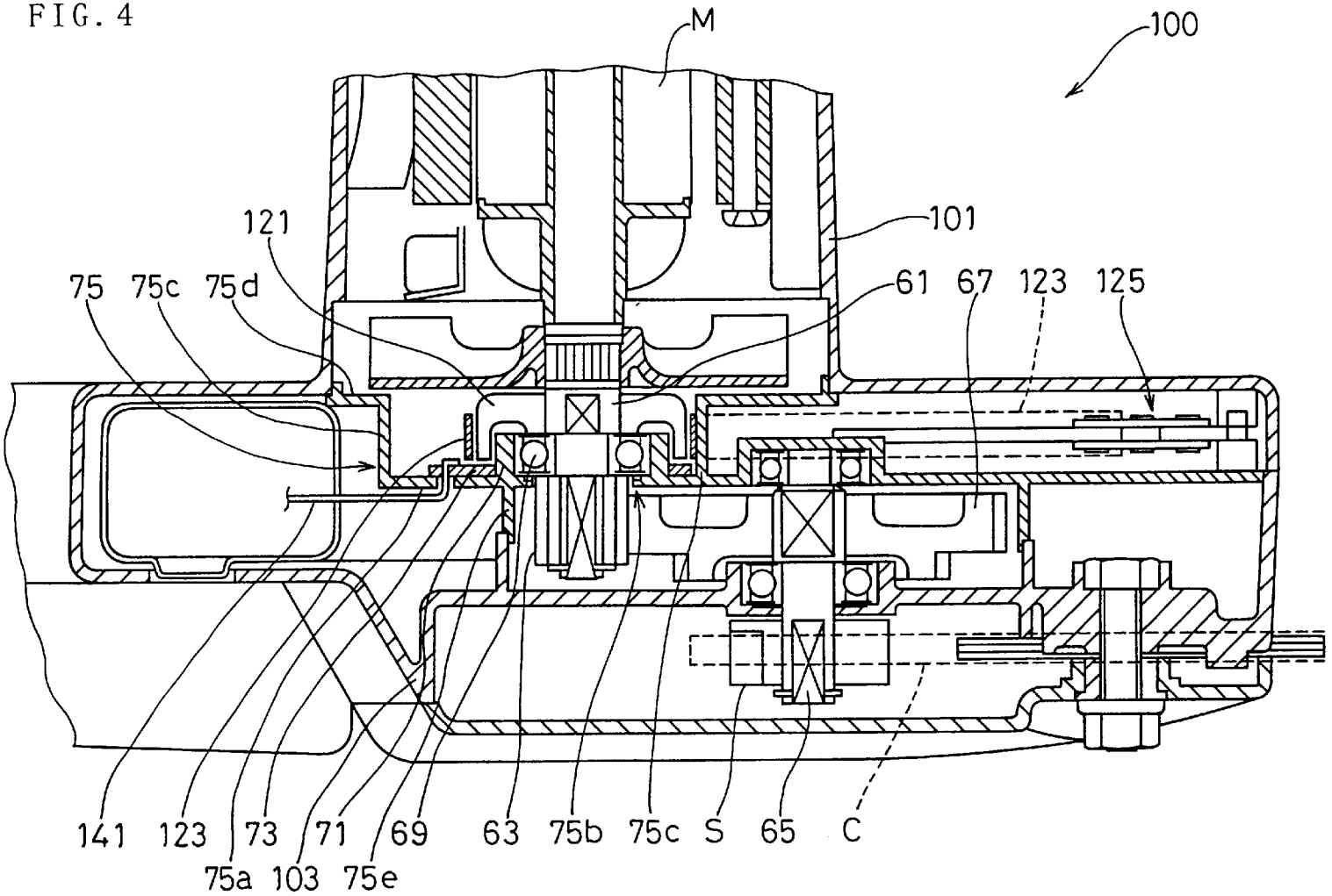
FIG. 4 is a partial sectional view of a chain saw according to a second embodiment of the invention.

As shown in FIG. 4, a motor M is disposed in a housing 101 of a chain saw 100. A motor axis 61 of the motor M is rotatably supported by a bearing 69. A bearing holder 71 for holding the bearing 69 is constituted as a part of a support box 75 supported and fixed in the housing 101. In a bottom 75*a* of the support box 75, a through hole 75*b* is provided, through which the motor axis 61 supported by the bearing 69 is extended downward. On an end of the motor axis 61, a pinion 63 is attached. The pinion 63 meshes with a flat gear 67 attached to a rotary axis 65 for supporting a sprocket S. Therefore, a rotary drive force of the motor M is transmitted to a chain C engaged with the sprocket S, thereby rotating the chain C.

Figure 5:
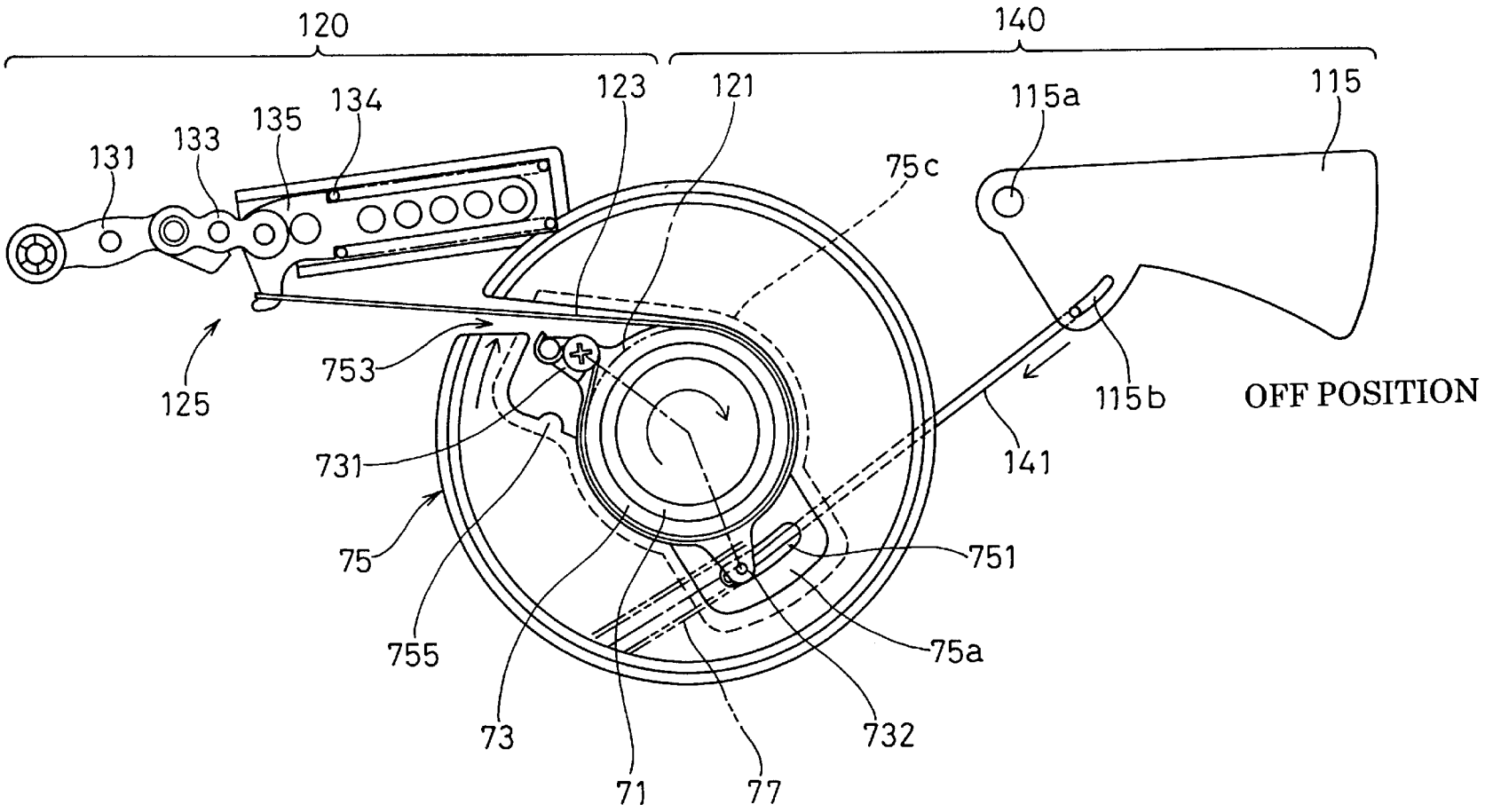
FIG. 5 is a diagrammatic representation showing a trigger lever released in the second embodiment.

Referring to FIGS. 4 and 5, to the motor axis 61, a brake drum 121 rotating integrally with the motor axis 61 is attached. Around the brake drum 121 is disposed a brake band 123. On an outer peripheral surface of the cylindrical bearing holder 71, a rotary ring 73 is rotatably disposed in a predetermined angular range, opposite to the brake drum 121.

As shown in FIG. 5, also in the second embodiment, a brake device 120 acting with the hand guard (not shown in FIGS. 4 to 7), and a brake device 140 acting with a trigger lever 115 for turning on or off the drive switch (not shown in FIGS. 4 to 7).

The rotary ring 73 is provided with two protrusions 731 and 732 apart from each other by 267 degrees and extended from an outer surface of the rotary ring 73. One protrusion 731 of the rotary ring 73 is coupled to one end of the brake band 123 wound around the brake drum 121. The other end of the brake band 123 is connected to a linkage 125, the same as the linkage 25 shown in FIG. 3, which acts in cooperation with operation of the hand guard. The other protrusion 732 of the rotary ring 73 is connected to one end of a connecting rod 141. In the bottom 75*a* of the support box 75, an elongated hole 751 is provided, via which the connecting rod 141 extended along a rear side of the support box 75 and connected to the protrusion 732. The other end of the connecting rod 141 is inserted in an elongated hole 115*b* formed in the trigger lever 115 rotatably centering on a support axis 115*a*. The protrusion 732 is connected to one end of a tension spring 77, and the rotary ring 73 is usually biased in a clockwise direction.

The support box 75 has a cylindrical peripheral wall 75*c* (see FIG. 4) extending upward from the bottom 75*a*. In the peripheral wall 75*c*, a notch 753 is provided, and the brake band 123 is extended outside the support box 75 via the notch 753 and connected to a link plate 135 of the linkage 125. A part of an inner surface of the peripheral wall 75C having the notch 753 protrudes inwardly, thereby constituting a stopper 755. The stopper 755 abuts on the rotary ring 73, thereby stopping rotation thereof, when the rotary ring 73 is rotated counterclockwise. The rotary ring 73 is rotatable between a position corresponding to an off position of the trigger lever 115 and a position defined by the stopper 755 The support box 75 has a flange 75*d* extended radially outside from an upper end of the peripheral wall 75*c* and a leg 75*e* extended downward from the bottom 75*a*. A step provided on the flange 75*d* engages with a part of the housing 101 of the chain saw 100, and the leg 75*e* is supported by a part of the housing 103 of the chain saw 100. Therefore, the support box 75 is securely fixed in the housings 101 and 103 of the chain saw 100.

Operation of the second embodiment is now described.

Referring to FIG. 5, operation when the trigger lever 115, is at its off position and the hand guard is at its initial position (not turned down) is described. Since the hand guard is at the initial position, three link plates 131, 133 and 135 are aligned substantially straight and push back a coil spring 134. However, since the rotary ring 73 is biased clockwise by the tension spring 77, the brake band 123 is tightened around the brake drum 121 by the rotary ring 73. Therefore, a brake force is exerted on the motor axis 61.

Figure 6:
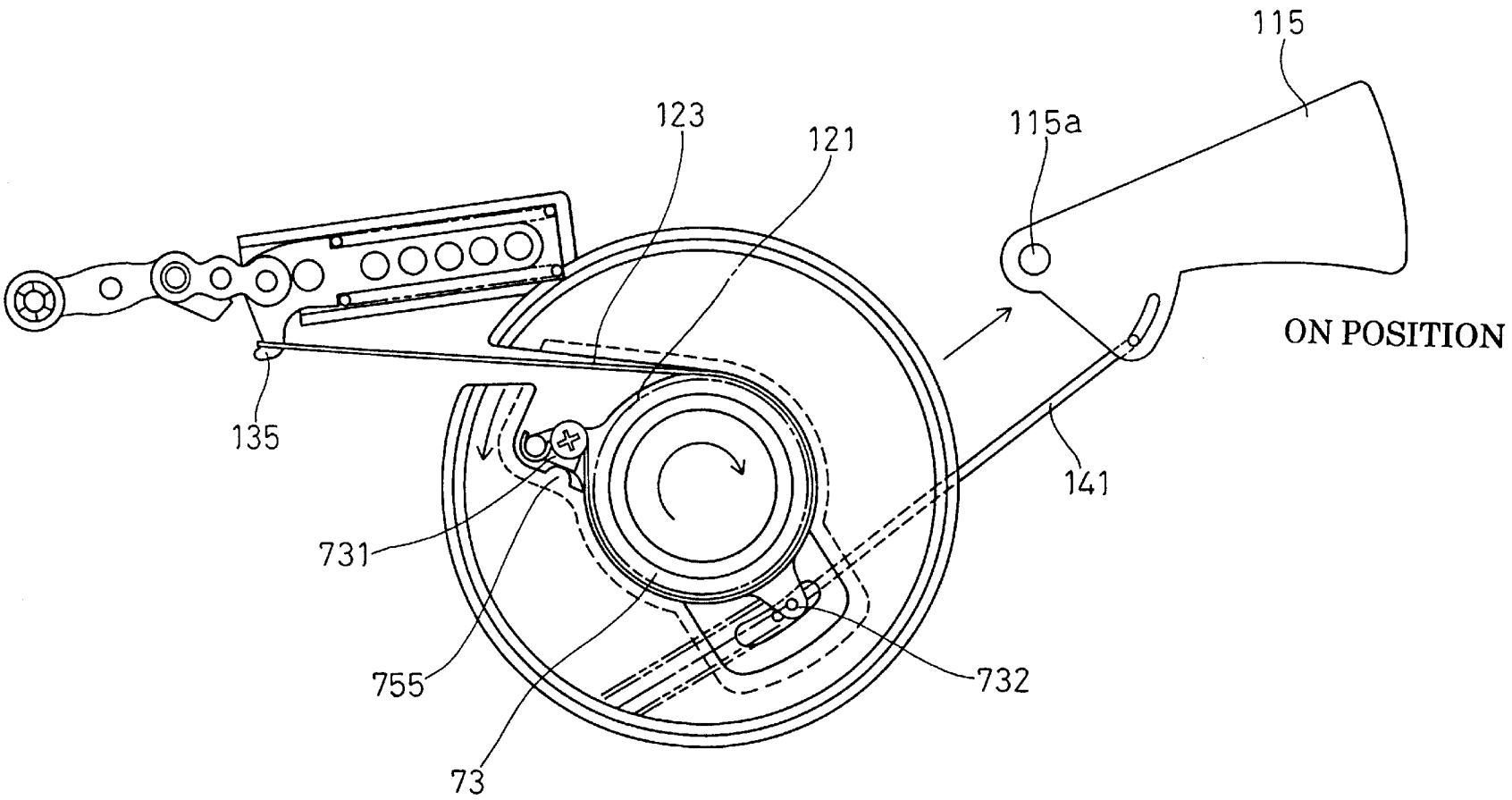
FIG. 6 is a diagrammatic representation showing the trigger lever gripped in the second embodiment.

As shown in FIG. 6, when the trigger lever 115 is gripped and moved to its on position, the connecting rod 141 connected to the trigger lever 115 is pulled toward the trigger lever 115. Then, the rotary ring 73 is rotated counterclockwise against a biasing force of the tension spring 77 and abuts on the stopper 755, thereby stopping. As a result, the brake band 123 wound around the brake drum 121 is loosened, and no brake force is exerted on the motor axis 61. Therefore, when the trigger lever 115 moves to its on position, a drive switch (not shown) turns on, to drive the motor M and rotate the motor axis 61.

Figure 7:
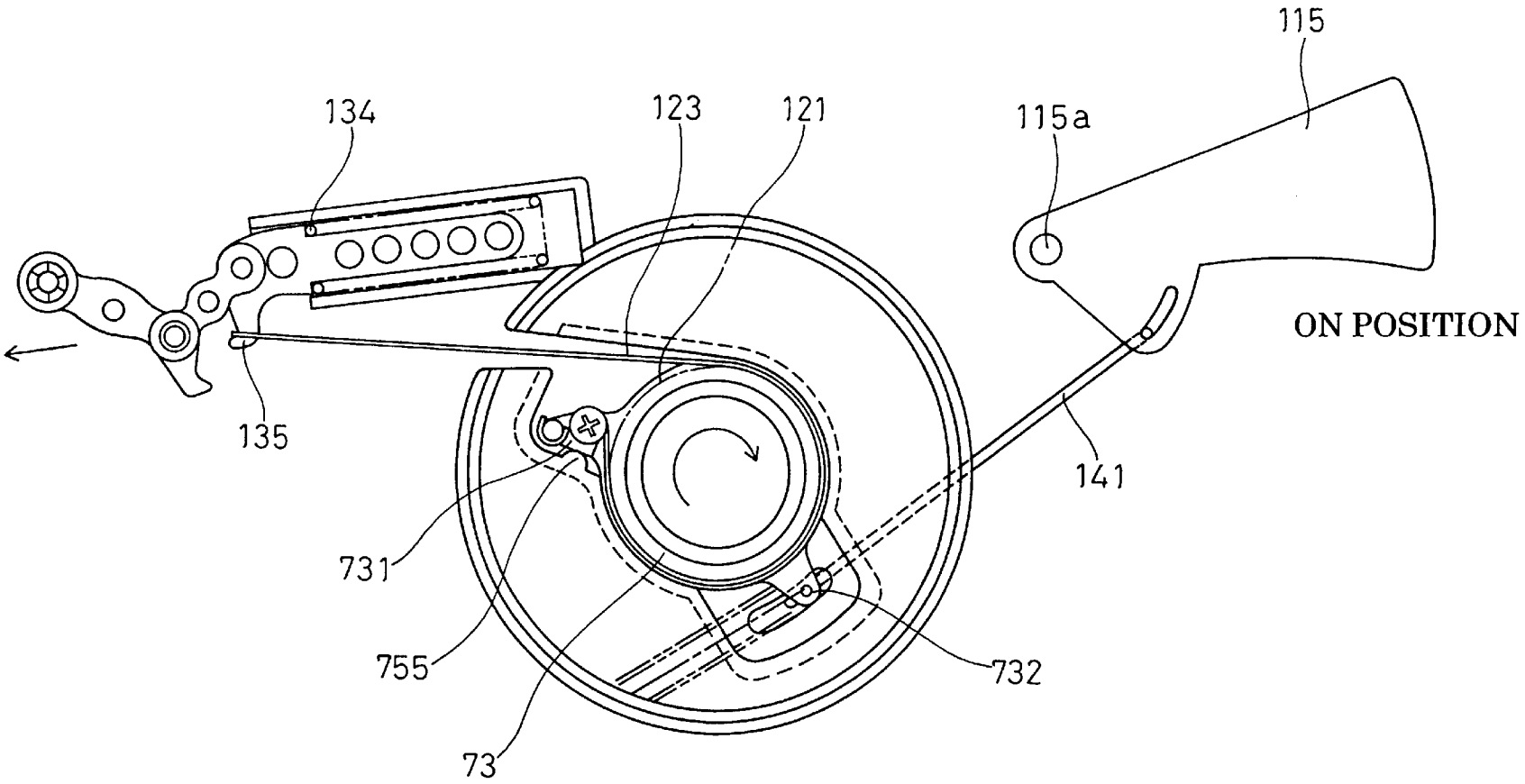
FIG. 7 is a diagrammatic representation showing a hand guard turned down while the trigger lever is gripped.

As shown in FIG. 7, when the trigger lever 115 is at the on position and a kick-back acts to turn down the hand guard, in the same manner is shown by a dotted line in FIG. 3, the link plate 131 is pushed down, and the rear-end plate 135 is moved to the left as seen in the figure. Thereby, the other end of the brake band 123 is pulled, and the brake band 123 is tightened around the brake drum 121. As a result, the brake force is exerted on the motor axis 61, and the motor m is forced to stop.

What is claimed is:

1. A chain saw having a brake device comprising:

a cutting chain wound around a guide bar, where said guide bar is an extension from a housing;

a drive means for providing a rotary drive force to a drive sprocket onto which said cutting chain is wound;

a trigger lever for energizing said drive means when turned on and for stopping said drive means when turned off;

a brake band freely wound around a brake drum rotating together with said drive sprocket; and a hand guard connected to a first end of said brake band, said hand guard exerting a pulling force on said first end of said brake band to tighten said brake band around said brake drum thereby stopping said cutting chain, a second end of said brake band being connected to said trigger lever by a connecting member, the trigger lever pulling said second end of said brake band via said connecting member in a direction opposite to a direction in which said first end of said brake band is pulled by operation of the hand guard, thereby being moveable from an off position, in which said brake band is pulled and tightened, to an on position, in which said brake band is released and loosened.

2. A chain saw having a brake device according to claim 1, wherein said connecting member further includes a substantially rigid rod for positively pushing said brake band into a position in which the brake band is loosened when said trigger lever is turned on.

3. A chain saw having a brake device according to claim 2, wherein an urging member is attached to said rod, said connecting member also includes a moveable member disposed between said trigger lever and said rod to push said rod against the urging force of said urging member, when said trigger lever is turned on by gripping said trigger lever to loosen said brake band thereby allowing said brake drum to rotate, said rod being released by the extension of said urging member and said brake band being pulled and tightened around said brake drum when said trigger lever is turned off.

4. A chain saw having a brake device according to claim 2, wherein said connecting member further includes a rotary ring to which said second end of said brake band wound around the brake drum is connected, said rod is connected to said rotary ring, and said trigger lever rotates to allow said rotary ring to rotate and pull said second end of said brake band, thereby tightening said brake band around said brake drum, when said trigger lever is turned on.

5. A chain saw having a brake device provided with a cutting chain wound around a guide bar, wherein said guide bar is an extension from a housing; a drive means for providing a rotary drive force to a drive sprocket onto which said cutting chain is wound; and a brake band freely wound around a brake drum rotating together with said drive sprocket; wherein said chain saw brake device comprises a hand brake device and a normal brake device, said hand brake device and said normal brake device being independently operable; said hand brake device having a hand guard connected to a first end of said brake band by a linkage, which when said hand guard is activated pulls said first end of said brake band to tighten said brake band around said brake drum to stop said cutting chain; and said normal brake device comprises a trigger lever for activating said drive means when turned on and for stopping said drive means when turned off, a second end of said brake band being connected to a connecting member to act with said trigger lever to pull and tighten said brake band about said brake drum when said trigger lever is turned off and to release and loosen said brake band when said trigger lever is turned on.

6. A chain saw having a brake device according to claim 5, wherein said connecting member further includes a substantially rigid rod for positively pushing said brake band into a position in which the brake band is loosened when said trigger lever is turned on.

7. A chain saw having a brake device according to claim 6, wherein an urging member is attached to said rod, said connecting member also includes a moveable member disposed between said trigger lever and said rod to push said rod against the urging force of said urging member when said trigger lever is turned on by gripping said trigger lever to loosen said brake band thereby allowing said brake drum to rotate, said rod being released by the extension of said urging member and said brake band being pulled and tightened around said brake drum when said trigger lever is turned off.

8. A chain saw having a brake device according to claim 6, wherein said connecting member further includes a rotary ring to which said second end of said brake band wound around the brake drum is connected, said rod is connected to said rotary ring, and said trigger lever rotates to allow said rotary ring to rotate and pull said second end of said brake band, thereby tightening said brake band around said brake drum, when said trigger lever is turned on.

* * * * *